US005464379A

United States Patent [19]

Zarecky

[11] Patent Number: 5,464,379

[45] Date of Patent: Nov. 7, 1995

[54] VARIABLE WEIGHT DUMBBELL

[76] Inventor: Victor K. Zarecky, 1075 Colony Dr., Crystal Lake, Ill. 60014

[21] Appl. No.: 239,280

[22] Filed: May 6, 1994

Related U.S. Application Data

[63] Continuation-in-part of Ser. No. 51,460, Apr. 21, 1993.

[51] Int. Cl.[6] ..... A63B 21/075

[52] U.S. Cl. ..... 482/108; 482/106

[58] Field of Search ..... 482/106, 107, 482/108, 111

[56] References Cited

U.S. PATENT DOCUMENTS

| | | | |
|---|---|---|---|
| 1,536,048 | 5/1925 | Alastalo . | |
| 1,991,520 | 2/1935 | Postl . | |
| 4,076,236 | 2/1978 | Ionel . | |
| 4,566,690 | 1/1986 | Schook . | |
| 4,681;315 | 7/1987 | Yang . | |
| 4,722,523 | 2/1988 | Yang . | |
| 4,913,422 | 4/1990 | Elmore et al. . | |
| 5,033,740 | 7/1991 | Schwartz et al. . | |
| 5,040,787 | 8/1991 | Brotman | 482/106 |
| 5,090,693 | 2/1992 | Liang . | |

FOREIGN PATENT DOCUMENTS

| | | |
|---|---|---|
| 1031855 | 6/1953 | France . |

OTHER PUBLICATIONS

Vlier, '94 Pocket Catalog & Product Information Guide; Cover page, pp. 1–8 and 40–41.

*Primary Examiner*—Lynne A. Reichard
*Attorney, Agent, or Firm*—Wallenstein & Wagner, Ltd.

[57] ABSTRACT

The invention is a singular or plurality of variable weight, thread-socketed dumbbell system comprising a one-piece dumbbell and a plurality of removable attachable insert weights. The one-piece dumbbell comprises a handle bar fixedly attached to a pair of end-weights at opposing ends of the handle bar. Each end-weight may have one (1) to three (3) axially-aligned, inwardly-opening, threaded sockets. Each insert weight may be a disc-shaped weight having a protruding, threaded member. The insert weights are capable of removable attaching to the socketed end-weights. The invention further includes a singular or plurality of variable weight, lock-socketed, dumbbell structures comprising a one-piece dumbbell and a plurality of insert weights.

33 Claims, 4 Drawing Sheets

VARIABLE WEIGHT DUMBBELL

RELATED APPLICATION

This application is a continuation-in-part application of U.S. Ser. No. 08/051,460, filed Apr. 21, 1993 now abandoned.

DESCRIPTION

Technical Field

Some forms of fixed and adjustable weight dumbbells are known in the art. Known fixed-weight dumbbells comprise a steel handle and two ends whereas known adjustable-weight dumbbells further include two or more attachable weights per dumbbell structure. Known dumbbell sets cover weight ranges generally by varying the size of the ends and number of inter-attachable weights. For example, adjustable-weight dumbbells are disclosed U.S. Pat. Nos. 5,090,693; 4,566,690; 1,991,520; 1,536,048; 4,076,236; and 4,722,523.

However, these known dumbbells have several disadvantages that are solved by the present invention. A set of fixed-weight dumbbells requires substantially more steel to make enough sets of dumbbells to achieve the same weight range as the present invention.

In addition, the design and construction of known adjustable-dumbbells is hazardous and cumbersome to use. Some adjustable-weight dumbbells employ a stacking-type configuration for the attachable weights. By stacking-type it is meant that the attachable weights attach to each other building away from the handle. This stacking-type structure is hazardous due to an increased moment of inertia about the handle. The structure is also hazardous due to the particular types of connecting means employed and due to the number of attachable weights used. Correspondingly, the stacking-type structure is cumbersome to use because the attachable weight is distributed far from the handle. It is also cumbersome because several attachable weights may be necessary to achieve a desired weight range for the set. Moreover, changing the weight of stacking-type adjustable dumbbells for different exercises is very time consuming. This is a significant problem because time is valuable in maintaining a consistent workout flow, maintaining energy requirements, maintaining a level of heart rate, and achieving benefits from taxing muscular endurance.

In contrast, the dumbbell structure of the present invention has a comparatively lower moment of inertia about the handle and is less cumbersome. The inertia is lower because all of the removeably attachable insert weights connect directly to the end-weight. Consequently, the present dumbbell is unexpectedly less hazardous, less cumbersome and safer to use.

The present invention also requires unexpectedly less steel to cover the same range of weight as a set of known fixed-weight dumbbells. The present variable weight dumbbell only requires approximately one third (⅓) as much steel to cover the same weight range as known fixed-weight dumbbells. This advantage provides substantial savings in the form of reduced storage space, distribution and manufacturing costs. The invention also has substantially less components which further reduces the associated costs of manufacturing and distributing as compared to known fixed and adjustable dumbbells.

SUMMARY OF THE INVENTION

The present invention is a singular or plurality of variable weight, threaded-socket dumbbell system comprising a one-piece dumbbell having predetermined weight and a plurality of removable attachable insert weights having predetermined weights. The one-piece dumbbell comprises a handle bar fixedly attached to a pair of end-weights at opposing ends of the handle bar. A line running through the center of the handle defines an X-axis.

Each end-weight may have one (1) to three (3) axially-aligned, inwardly-opening, threaded sockets. When one socket is employed, it is aligned along the X-axis. The invention also may include two (2) to six (6) insert weights per one-piece dumbbell. Each insert weight comprises a disc-shaped weight having a protruding, threaded member. The insert weights are capable of removable attaching to the socketed end-weights. Each and every protruding, threaded member is capable of removable attaching to each and every axially-aligned, inwardly-opening, threaded socket of each and every end-weight. The insert weights are secured to the end-weights by friction acting between the corresponding threads of the axially-aligned, inwardly-opening sockets and protruding members. The thread-socketed variable weight dumbbell further includes a means for preventing attachment of axially successive weights to either of said insert weights.

Another aspect of the invention is a singular or plurality of variable weight, lock-socket, dumbbell structures comprising a one-piece dumbbell of predetermined weight and a plurality of insert weights. Two (2) to six (6) insert weights per one-piece dumbbell may be used. The one-piece dumbbell includes a handle bar fixedly attached to a pair of end-weights. A line running through the center of the handle defines an X-axis.

Each of the end-weights may have one (1) to three (3) axially-aligned, inwardly-opening sockets having a plurality of spring-loaded plungers disposed therein. When one socket is employed, it is aligned along the X-axis. Each socket may have two (2) spring-loaded plungers which act as a releasable locking means. The insert weights may be disc-shaped having a protruding member therefrom. Each protruding member has a plurality of axial grooves and a circumferential groove having a circumferential camming surface and a plurality of locking indentations therein. Preferably, each protruding member has two (2) axial grooves and two (2) locking indentations. The lock-socketed variable weight dumbbell further comprises a means for preventing attachment of axially successive weights to either of said insert weights.

The insert weight can be made by machining steel into a single, solid insert weight. Each protruding member has two (2) types of grooves: axial and circumferential. Preferably, each circumferential groove has two (2) locking indentations at the groove's apex. The circumferential groove also has a circumferential camming surface. Each and every insert weight is capable of removable attaching and locking to each and every axially-aligned, inwardly-opening socket of the one-piece dumbbells.

The invention further includes a method of varying the weight of a variable weight dumbbell. The insert weight is attached to the end-weight by axially sliding the protruding member into the axially-aligned, inwardly-opening socket such that the plunger slides along the axial groove until it reaches the circumferential groove. The insert weight is locked into the end-weight by, first, radially turning the insert weight such that the plunger engages the camming surface within the circumferential groove, compressing the plunger. The insert weight is locked into the end-weight by rotating the insert weight so that the plungers engage the locking indentations decompressing the plungers. The method further provides that no successive weights may be attached to variable weight dumbbell due to a means for preventing attachment to either of said insert weights.

The insert weight is unlocked by rotating it such that the plungers disengage from locking indentations, re-compressing the plunger against the circumferential camming surface. The insert weight is removed from the end-weight by axially rotating the insert weight such that the plungers disengage from the circumferential camming surface, redecompressing the plungers. At this point, the plungers are axially aligned with the axial groove. Then, the insert weight is pulled along the X-axis so that the plungers slide through the axial grooves, thus, removing the insert weight from the end-weight.

Still another aspect of the invention is a set of dumbbells comprised of a plurality of variable weight dumbbells. The set of variable weight dumbbells may comprise from two (2) one-piece dumbbells and two (2) insert weights to twenty-two (22) one-piece dumbbells and six (6) or more insert weights. Other preferred sets include four pairs of dumbbells having weights of 5, 5, 12.5, 12.5, 20, 20, 35, and 35 pounds and comprises six pairs of insert weights having weights of 1.25, 1.25, 1.25, 1.25, 2.5, 2.5, 2.5, 2.5, 5, 5, 5, and 5 pounds; two pairs of dumbbells having weights of 5, 5, 12.5, and 12.5 pounds and comprises four pairs of insert weights having weights of 1.5, 1.5, 1.5, 1.5, 2.5, 2.5, 2.5, and 2.5; and, seven pairs dumbbells having weights of 50, 50, 65, 65, 80, 80, 95, 95, 110, 110, 125, 125, 140, and 140. All sets may be composed of the lock-socketed or thread-socketed variable weight dumbbells described above.

The present invention may be made of known materials such as aluminum or iron. Preferably, the variable weight dumbbells are made of steel. The components of invention may be manufactured by known methods such as machining or casting. The handle may be smooth or, preferably, machined to a knurled grip.

BRIEF DESCRIPTION OF THE DRAWINGS

The objects and features of my invention are illustrated in the description and drawings.

DETAILED DESCRIPTION OF THE PREFERRED EMBODIMENTS

It is to be understood that the invention may be embodied in other specific forms by one of ordinary skill in the art without departing from its spirit or central characteristics. The present examples and embodiments are thus to be considered as illustrative and not restrictive, and the invention is not intended to be limited to the details of the listed embodiments. Rather, the invention is defined by the claims, and as broadly as prior inventions in the art will permit.

Figure 1:
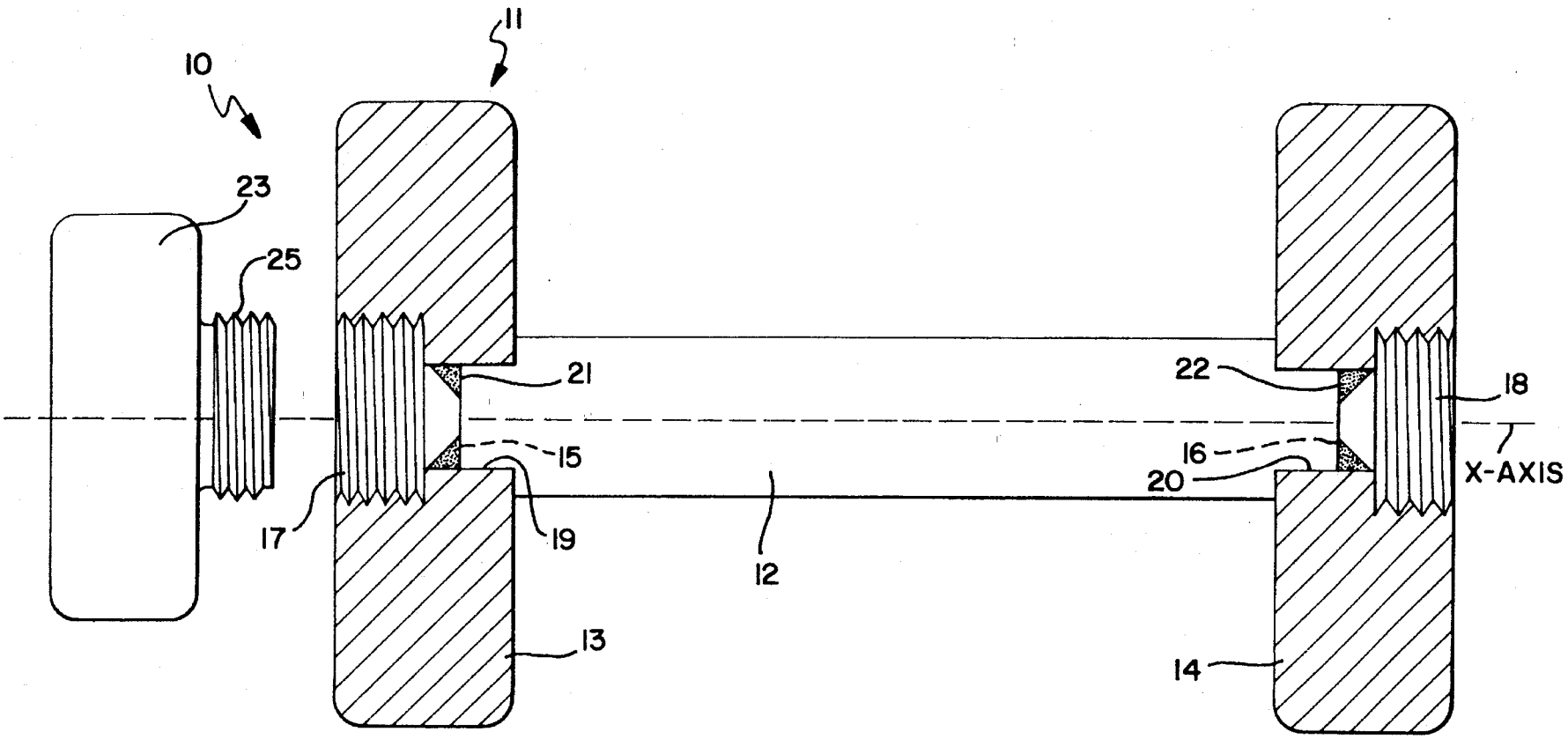
FIG. 1 is a partial cross sectional side view of a dumbbell structure having one axially-centered, axially-aligned, inwardly-opening, threaded, socket per end weight and showing one insert weight.

As shown in FIG. 1, one aspect of the present invention is a variable-weight, threaded-socket, dumbbell system 10 including a one-piece dumbbell 11 and two insert weights 23 (only one insert shown). The one-piece dumbbell 11 has a handle bar 12 fixedly attached to two (2) disk-shaped, end-weights 13, 14. The end-weights 13, 14 are substantially equal in weight. The handle bar 12 has two reduced ends 15, 16 that snugly fit into circular bores 19, 20 within the end-weights 13, 14. Annular welds 21, 22 fixedly attach the reduced ends 15, 16 to the end-weights 13, 14 (respectively).

Each end-weight 13, 14 also has one axially-aligned, inwardly-opening-threaded, axially-centered, socket 17, 18 (respectively). The sockets 17, 18 are centered along an axis X running through the center of the handle bar 12.

Each insert weight 23 has a protruding, threaded member 25 that is adapted to threadingly engage the sockets 17, 18 of a plurality of dumbbells 10. That is, every insert weight 23 may threadingly engage and removable attach to any end-weight of the plurality of dumbbell structures. Every insert weight 23 is also constructed to prevent successive attachment of axially successive weights by means of having only one (1) means of attachment per insert weight 23. Thus, the insert weight 23 may only be removable attached to the end-weight 11 and not to another insert weight. The end-weights 13, 14 and the insert weights 23 may be generally round as shown in the drawings, or may be of hexagonal, octagonal or other shapes.

Figure 2:
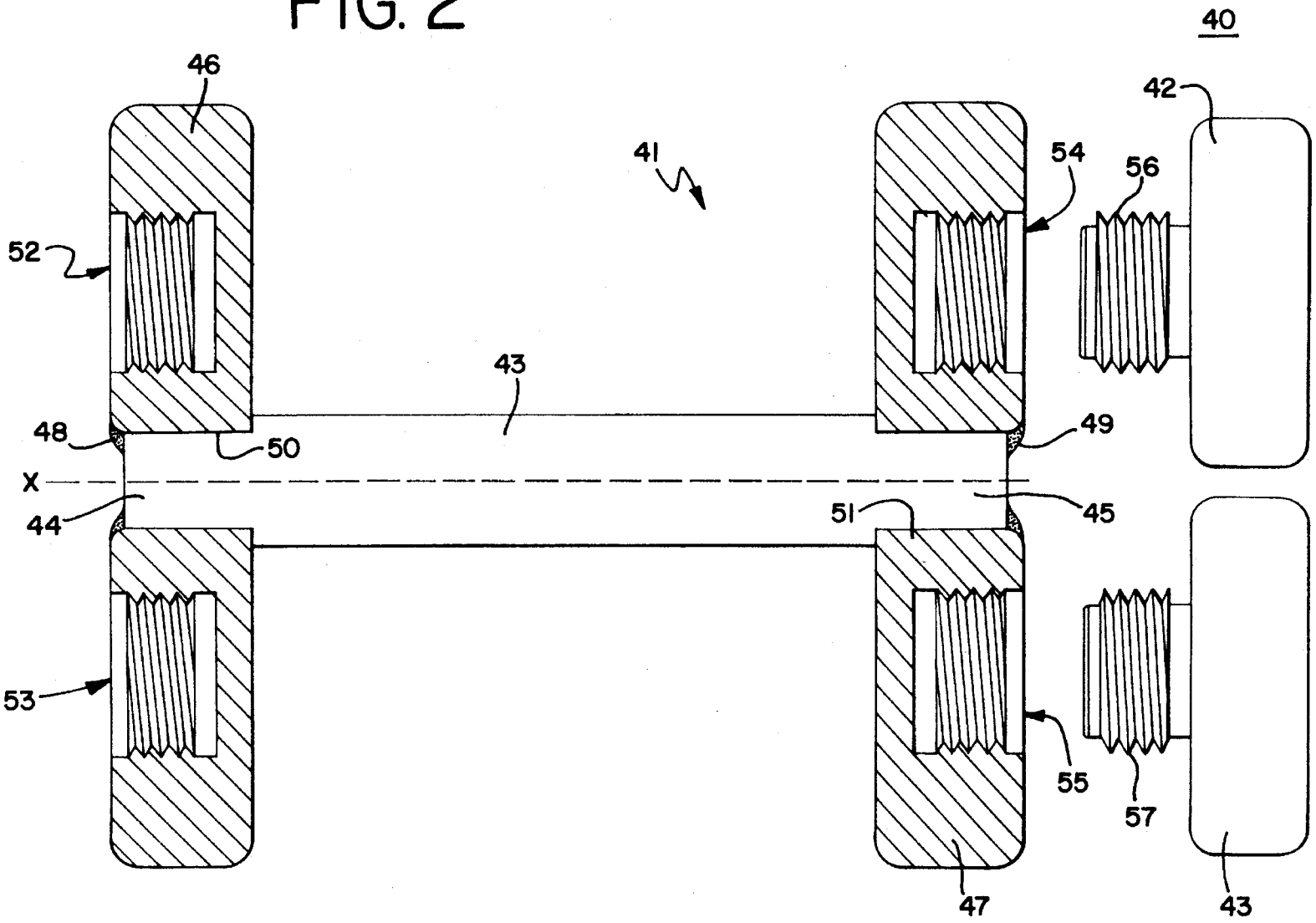
FIG. 2 is a partial cross sectional side view of a dumbbell structure having two axially-aligned, inwardly-opening, threaded sockets per end weight and showing two insert weights.

As shown in FIG. 2, another aspect of the invention is a variable weight dumbbell structure 40 comprising a one-piece dumbbell 41 and four (4) insert weights 42, 43 (only two inserts shown). The one-piece dumbbell 41 comprises a handle bar 43 having two reduced ends 44, 45 that are fixedly attached to two respective end-weights 46, 47 by annular welds 48, 49. The reduced ends 44, 45 snugly fit into circular bores 50, 51 centered within the disk-shaped end-weights 46, 47.

Each end-weight 46, 47 has two threaded sockets 52, 53, 54, 55 (respectively) and each insert weight 42, 43 has a protruding, threaded member 56, 57 (respectively). The threaded sockets 52, 53, 54, 55 are radially spaced from the axis x running through the center of the handle bar 43. All protruding, threaded members 56, 57 (only two members shown) are capable of threadingly engaging and removable attaching to the threaded sockets 52, 53, 54, 55. Every insert weight 42, 43 is also constructed to prevent successive attachment of axially successive weights by means of having only one (1) means of attachment per insert weight 42, 43. Thus, the insert weights 42, 43 may only be removable attached to the end-weights 46, 47 and not to another insert weight.

Figure 3:
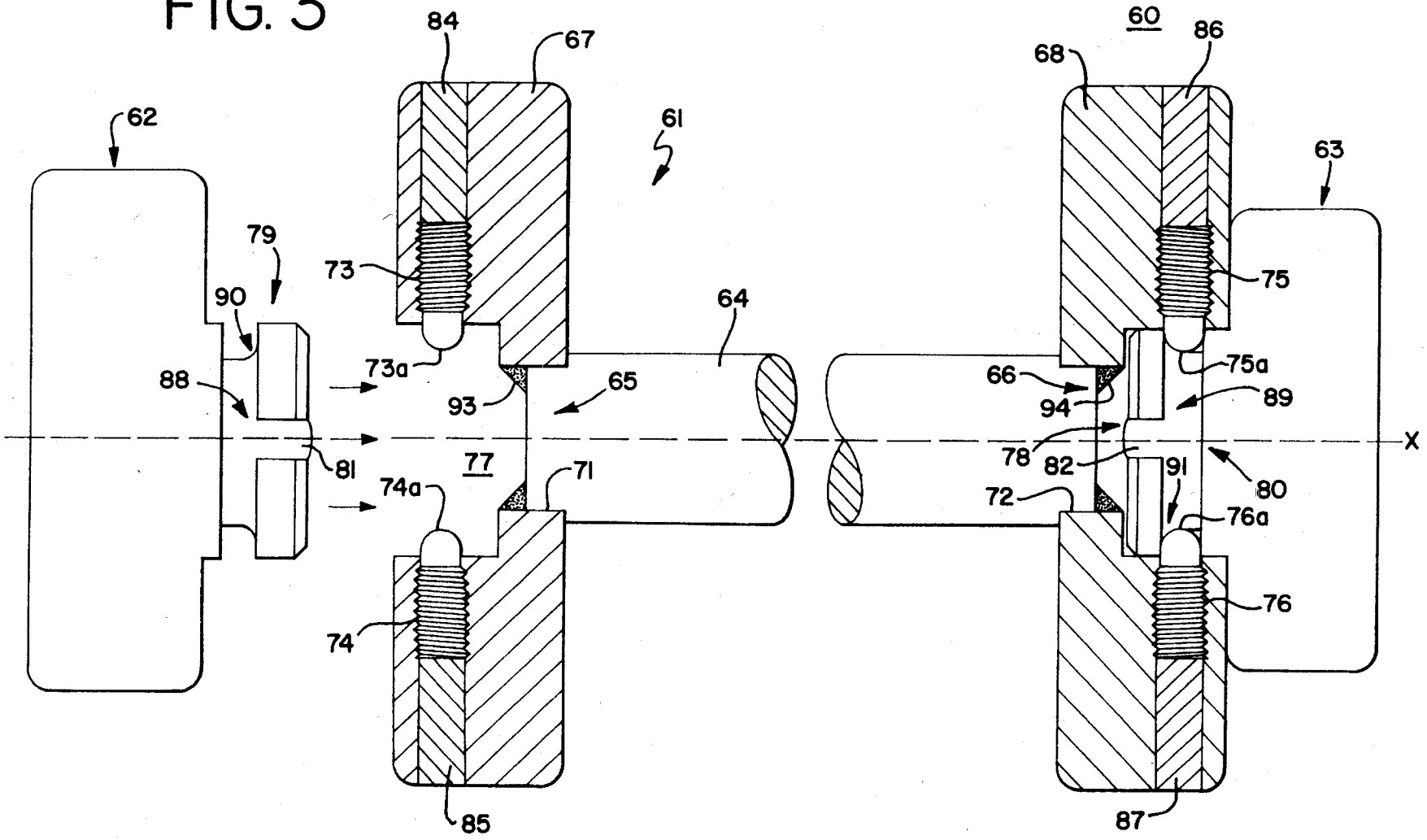
FIG. 3 is a partial side cross sectional view of a dumbbell structure having an axially-centered, axially-aligned, inwardly-opening socket on each end-weight with two plungers disposed therein and two insert weights each having a protruding member thereof.

As shown in FIG. 3, another aspect of the present invention is a lock-socketed, dumbbell structure 60 comprising a one-piece dumbbell 61 and two (2) insert weights 62, 63. The one-piece dumbbell 61 includes a handle bar 64 having reduced ends 65, 66 which are fixedly attached to disc-shaped end weights 67, 68 (respectively) by annular welds 93, 94. The reduced ends 65, 66 fit snugly into circular bores 71, 72 within the end weights 67, 68.

Each end-weight 67, 68 has two sets of spring-biased plunger assemblies 73, 74, 75, 76 disposed therein and radially-aligned to an axis x running through the center of the handle bar 64. Round steel plugs 84, 85, 86, 87 are used to plug residual bores left behind the plungers 73, 74, 75, 76. Each plunger 73, 74, 75, 76 has a respective plunger tip 73*a*, 74*a*, 75*a*, 76*a* adapted to rest within the sockets 77, 78 in each end weight 67, 68 when assembled. Each socket 77, 78 is capable of engaging and removable attaching to each protruding member 79, 80 on the insert weights 62, 63. Each and every protruding member 79, 80 is capable of removable attaching to each and every socket 77, 78.

Every insert weight 62, 63 is also constructed to prevent successive attachment of axially successive weights by means of having only one (1) means of attachment per insert weight 62, 63. Thus, the insert weights 62, 63 may only be removable attached to the end-weights 67, 68 and not to another insert weight.

Figure 5:
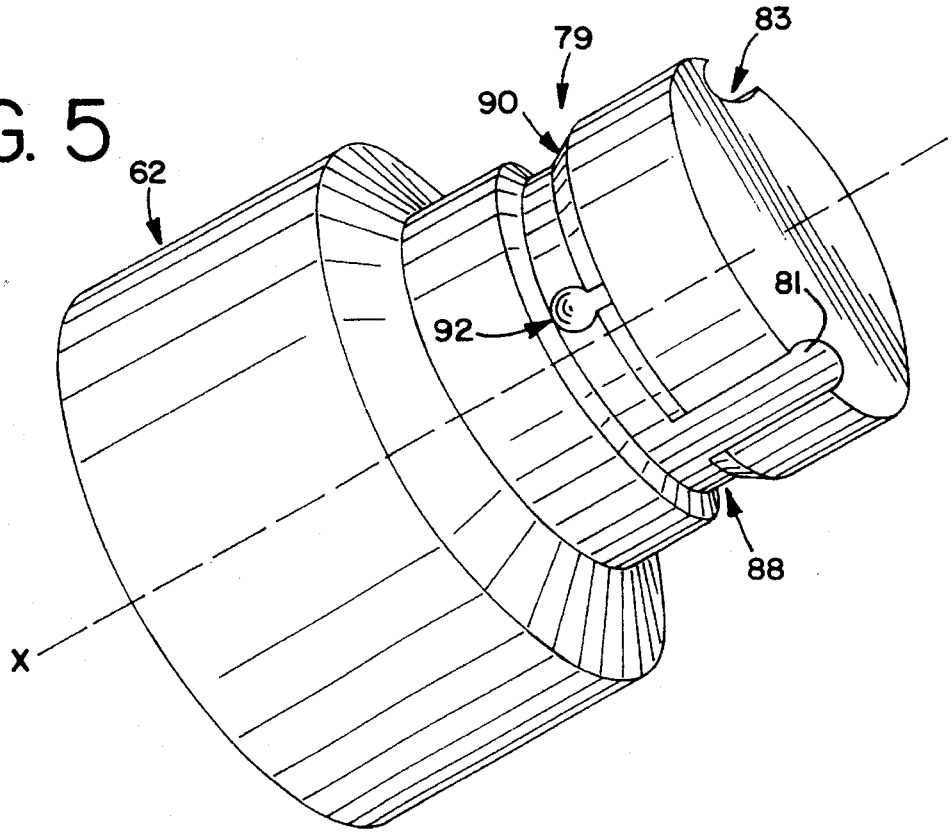

As shown in FIGS. 3 and 5, each of the protruding members 79, 80 has two (2) axial grooves 81, 82 (only one axial groove, 83, is shown on member 80) running parallel to the axis X and, radially, 180 degrees apart with respect to the axis X. Each protruding member 79, 80 also has a respective one circumferential groove 88, 89 running circumferentially around the axis X and having a respective circumferential camming surface 90, 91. Each circumferential groove 88, 89 also has two (2) locking indentations 92 (only indentation shown in FIG. 5) located, radially, 180 degrees apart with respect to the axis X.

Figure 4:
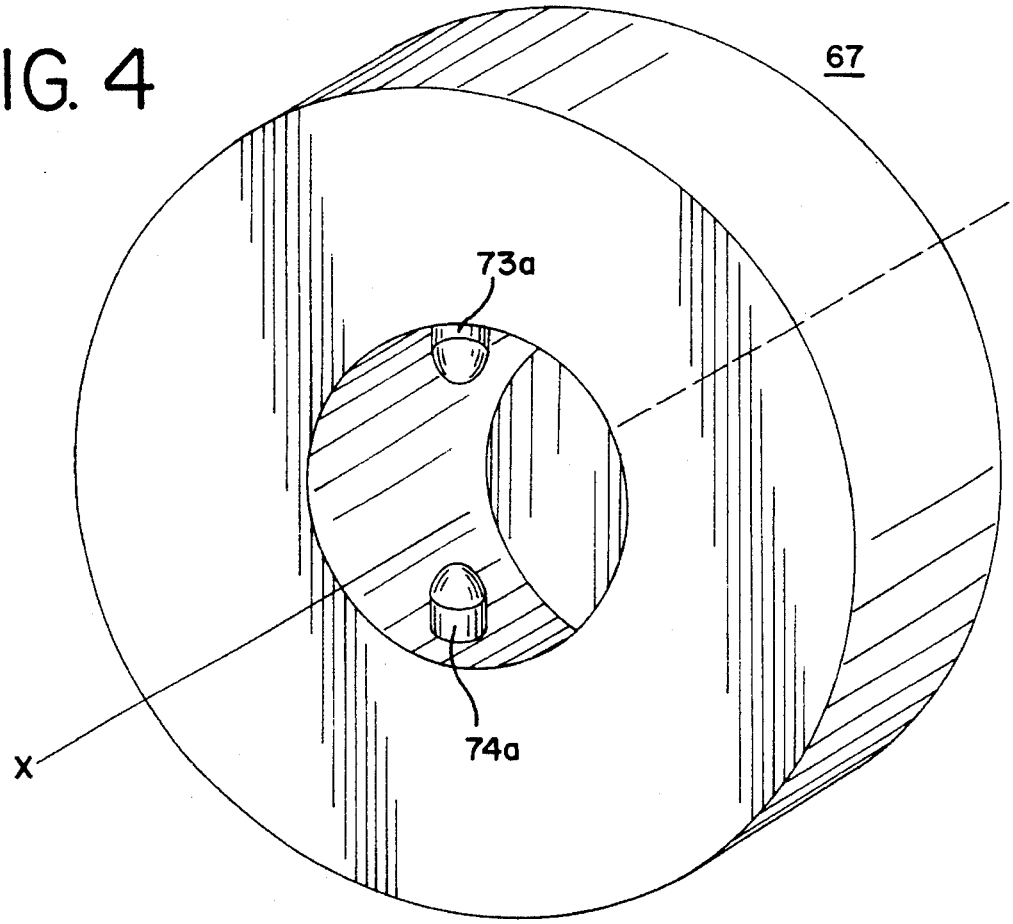
FIG. 4 is an end perspective view of an end weight having one axially-centered, axially-aligned, inwardly-opening socket with two plungers therein; and, FIG. 5 is a side perspective view of an insert weight having perpendicular annular grooves and a locking indentation.

As shown in FIGS. 3 and 4, the plunger tips 73*a*, 74*a*, 75*a*, 76*a* are disposed within each of the sockets 77, 78. The plungers 73, 74, 75, 76 are located, radially, 180 degrees apart relative to the axis x running through the center of the handle bar 64. The plungers 73, 74, 75, 76 may be one sold under the name Vlier® "POSI-HEX" PH-54 or PH-55 and manufactured by Vlier, a division of Applied Power Corporation, located in Burbank, California; the description of which in the "'94 Pocket Catalog & Product Information Guide" at pp. 40–41 is incorporated herein by reference. The plunger spring should be rated at 2–20 pounds per square inch. Preferably, the spring is 4 or 13 psi.

Another aspect of my invention is a method of varying the weight of dumbbells. As depicted in FIG. 3, the insert weight 62 is attached to the end-weight 67 by axially sliding the protruding member 79 into socket 77 such that the plungers 73, 74 slide along the axial groove 81 until they reach the circumferential groove 88 (Note that the insert weight 62 shown in FIG. 3 must be rotated 90 degrees about the axis X to align the plungers 73, 74 with the axial grooves 81, 83 to facilitate proper attachment). Then, the insert weight 62 is locked into the end-weight 67 by, first, radially turning the insert weight 62 such that the plungers 73, 74 engage the circumferential camming surface 90 within the circumferential groove 88 compressing the plungers 73, 74. The insert weight 62 is locked into the end-weight 67 by further rotating the insert weight 62 so that the plungers 73, 74 engage the locking indentations 92 (only indentation shown) decompressing the plungers 73, 74.

The insert weight 62 is unlocked by rotating the insert weight 62 such that the plungers 73, 74 disengage from locking indentations 92 recompressing the plunger against the circumferential camming surface 90. The insert weight 62 is removed from the end-weight 67 by rotating the insert weight 62 such that the plungers 73, 74 disengage from the circumferential camming surface 90 re-decompressing the plungers 73, 74. At this point, the plungers 73, 74 are axially aligned with the axial grooves 81, 83. Then, the insert weight 62 is pulled along the X-axis so that the plungers 73, 74 slide through the axial grooves 81, 83, thus, removing the insert weight 62 from the end-weight 67.

In addition, no insert weight 62, 63 may be removable attached to another insert weight because each insert weight 62, 63 is constructed to prevent successive attachment of axially successive weights. Successive attachment is prevented by means of having only one (1) means of attachment per insert weight 62, 63. Thus, the insert weights 62, 63 may only be removable attached to the end-weights 67, 68 and not to another insert weight.

EXAMPLES

Two preferred sets of variable weight dumbbells include a threaded-socket and a plunger-socketed type as illustrated in FIGS. 1 and 3, respectively. Each set includes the following components.

Insert Weights

Four (4) each of 1.25, 2.5, and 5 pounds. Each insert weight of the plunger-socketed set has two (2) locking indentations 180° apart.

One-Piece Dumbbells

Two (2) each of 5, 12.5, 20, 35, 50, 65, 80, 95, 110, 125, and 140 pounds. Each one-piece dumbbell of the plunger-socketed set has two (2) plungers in each end-weight 180° apart.

This set of dumbbells structures including insert weights and one-piece dumbbells covers a weight range of 5 to 150 pounds. The user also has the flexibility of varying the weight of each dumbbell in 1.25, 2.5 and 5 pound increments. This feature unexpectedly reduces the amount of steel necessary to achieve a weight range comparable to prior dumbbell sets and unexpectedly reduces the cost of manufacturing, storage, handling and transportation. The unique attaching and securing means employed in the invention also reduces the risks and hazards associated with prior dumbbells without sacrificing cost or practicability.

While the preferred form of the invention has been specifically illustrated and described herein, it will be apparent to those skilled in the art that modifications and improvements may be made to the form herein specifically disclosed. Accordingly, the present invention is not to be limited to the form herein specifically disclosed or in any other way inconsistent with the progress in the art promoted by this invention.

I claim:

1. A variable weight dumbbell system comprising:

a dumbbell having a handle bar having first and second bar ends defining an x-axis;

first and second end-weights at the respective first and second bar ends and each having at least one threaded socket connector; and at least four insert weights, each having only a single connector and that being a single protruding, threaded portion capable of removably attaching the same to one of said first and second end-weights through a mating threaded socket thereon, whereby any one of the insert weights is only capable of removably attaching to one of the end-weights and is incapable of receiving another insert weight.

2. The variable weight dumbbell system of claim 1 or 27 wherein said first and second end-weights each have at least two identical threaded sockets whereby each dumbbell end-weight can support one or more separate insert. weights and wherein there is provided at least two pairs of said insert weights for insertion into said sockets, each pair being of the same weight.

3. The variable weight dumbbell system of claim 1, 2 or 27 wherein said sockets of said first and second end-weights are aligned and open outwardly in a direction coaxial or parallel with said X-axis.

4. The variable weight dumbbell system of claim 1 or 27 wherein said first and second end-weights each have three sockets, and wherein the dumbbell includes at least six insert weights.

5. A variable weight dumbbell system comprising:

a dumbbell including a handle bar having first and second bar ends defining an x-axis and first and second end-weights, each of said end-weights having at least one socket and a spring-biased plunger attached within said first and second end-weights and extending into said socket;

at least first and second insert weights each having a protruding portion having at least one groove to receive said plunger during attachment or detachment of the insert weight and a locking indentation; and, means for preventing attachment of axially successive weights to either of said insert weights, wherein any of the insert weights are capable of removably attaching to each of the end-weights but are incapable of receiving another insert weight.

6. The variable weight dumbbell system of claim 5 wherein said protruding portions of said first and second insert weights each have two grooves parallel to said x-axis when mounted on an end weight on the handle bar and one circumferential groove having two locking indentations radially located 180 degrees apart, and wherein said first and second end-weights each have two of said spring-biased plungers radially located 180 degrees apart to enter said locking indentations.

7. The variable weight dumbbell system of claim 6 wherein each of said first and second end-weights has one socket centered and facing outwardly along said x-axis.

8. The variable weight dumbbell system of claim 6 wherein each of said first and second end-weights has two sockets facing outwardly in a direction parallel to said x-axis.

9. The variable weight dumbbell system of claim 6 wherein each of said first and second end-weights has three sockets facing in a direction parallel to said x-axis, and wherein the variable weight dumbbell includes six of said insert weights for connection to said end-weights.

10. A method of varying the weight of a variable weight dumbbell system comprising the following steps:

providing a variable weight dumbbell comprising a dumbbell including a handle bar having first and second bar ends defining an x-axis and first and second end-weights, each of said end-weights having at least one socket, each socket having a spring-biased plunger attached within said first and second end-weights and extending into said socket, first and second insert weights each having a protruding portion having at least one axial groove extending parallel to said x-axis and a plunger-receiving locking indentation opening outwardly in a direction transverse to said x-axis; and, means for preventing attachment of axially successive weights to either of said insert weights, wherein any of the insert weights are capable of removably attaching only to each of the end-weights;

attaching each insert weight to the dumbbell by sliding the protruding portion thereof into the socket such that the spring-biased plunger slides along said axial groove;

locking the insert weight by engaging the plunger with said locking indentation;

unlocking the insert weight by disengaging the plunger from the locking indentation; and, removing the insert weight from the dumbbell by pulling the insert weight along the x-axis so that the plunger slides entirely through the axial groove.

11. The method of claim 10 wherein each insert weight has at least two of said axial grooves extending in a direction parallel to said x-axis when mounted on the dumbbell and one outwardly opening circumferential groove into which said axial grooves extend and having at least two of said plunger-receiving locking indentations radially located 180 degrees apart and spaced from said axial grooves, and said first and second end-weights each have two of said spring-biased plungers radially located 180 degrees apart to be received in said indentations, and wherein said attaching step includes sliding the protruding portion of each insert weight to be attached to the dumbbell into the socket such that the spring-biased plungers slide along said axial grooves reaching the circumferential groove;

an additional step of rotating the insert weight such that the spring-biased plunger engages the wall of said circumferential groove;

said additional step includes rotating the insert weight so that the plungers enter said locking indentation;

said unlocking step includes rotating the insert weight such that the plungers disengage from the locking indentation and become axially aligned with the axial grooves; and, said removing step includes pulling the insert weight along the x-axis so that the plungers slide entirely through the axial grooves.

12. The method of claim 11 wherein said first and second end-weights have at each end thereof only one socket centered and opening outwardly along said x-axis.

13. The method claim 11 wherein said first and second end-weights each have two axially-inwardly-opening sockets, and wherein the variable weight dumbbell includes four insert weights.

14. The method of claim 11 wherein said first and second end-weights have at each end thereof three sockets opening outwardly in directions parallel to said x-axis and there is provided six of said insert weights.

15. A set of variable weight dumbbells comprising:

at least two pairs of dumbbells and at least four pairs of insert weights for connection to any one or more pairs of dumbbells, at least two pairs of the insert weights being of the same weight and the other two pairs of insert weights being of different weights and wherein each dumbbell comprises a handle bar having first and second bar ends defining an x-axis; and first and second end-weights, attached to respective ones of said first and second bar ends and having at least one threaded socket;

each of said insert weights having only one connector and that being a protruding, threaded portion capable of removably attaching to one of said first and second end-weights through the mating threaded socket thereon; and, whereby any one of the insert weights is only capable of removably attaching to each of the end-weights and is incapable of receiving another insert-weight.

16. The set of claim 15 wherein the set comprises four pairs of dumbbells having weights of 5, 5, 12.5, 12.5, 20, 20, 35, and 35 pounds and comprises six pairs of insert weights having weights of 1.25, 1.25, 1.25, 1.25, 2.5, 2.5, 2.5, 2.5, 5, 5, 5, and 5 pounds.

17. The set of claim 15 wherein the set comprises two pairs of dumbbells having weights of 5, 5, 12.5, and 12.5 pounds and comprises four pairs of insert weights having weights of 1.5, 1.5, 1.5, 1.5, 2.5, 2.5, 2.5, and 2.5 pounds.

18. The set of claim 15 wherein the set comprises seven pairs of dumbbells having weights of 50, 50, 65, 65, 80, 80, 95, 95, 110, 110, 125, 125, 140 pounds, and 140.

19. A set of variable weight dumbbells comprising:

a plurality of dumbbells each including a handle bar having first and second bar ends defining an x-axis;

first and second end-weights, each of said end-weights having a socket opening and at least one spring-biased plunger within said first and second end-weights and extending into said socket;

a plurality of insert weights each having a protruding portion adapted to be inserted into an end-weight socket and having a first groove adapted to slidably receive an end-weight and a locking indentation adapted to removably receive an end-weight plunger after being slidably received in said groove; and, a plurality of means for preventing attachment of axially successive weights to any of said insert weights, wherein any of the insert weights are capable of removably attaching to each of the end-weights but not to each other.

20. The set of claim 19 wherein said protruding members of said insert weights each have two of said first grooves parallel to said x-axis and one circumferential groove having two of said locking indentations, and with which said first grooves communicate and wherein said first and second end-weights each have two spring-biased plungers positioned to be removably received in said locking indentations.

21. The set of claim 20 wherein each of said end-weights has a plurality of said sockets; and wherein there is provided at least a number of insert weights equal in number to the number of sockets.

22. The set of claim 21 wherein the set comprises four pairs of dumbbells having weights of 5, 5, 12.5, 12.5, 20, 20, 35, and 35 pounds and comprises six pairs of insert weights having weights of 1.25, 1.25, 1.25, 1.25, 2.5, 2.5, 2.5, 2.5, 5, 5, 5, and 5 pounds, and wherein each end-weight has two spring-biased plungers 180 degrees apart and each insert weight has two radial locking indentations 180 degrees apart.

23. The set of claim 21 wherein the set comprises two pairs of dumbbells having weights of 5, 5, 12.5, and 12.5 pounds and comprises four pairs of insert weights having weights of 1.5, 1.5, 1.5, 1.5, 2.5, 2.5, 2.5, and 2.5 pounds wherein each end-weight has two spring-biased plungers 180 degrees apart and each insert weight has two radial locking indentations 180 degrees apart.

24. The set of claim 21 wherein the set comprises seven pairs dumbbells having weights of 50, 50, 65, 65, 80, 80, 95, 95, 110, 110, 125, 125, 140, and 140 pounds wherein each end-weight has two spring-biased plungers 180 degrees apart and each insert weight two radial locking indentations 180 degrees apart.

25. The set of claims 15 or 19 wherein the dumbbells and insert weights are made by casting steel.

26. The variable weight dumbbell system of claims 1 or 5 wherein the dumbbell and insert weights are made by casting steel.

27. A variable weight dumbbell system comprising essentially of:

at least one dumbbell having a handle bar with first and second bar ends defining an x-axis;

first and second end-weights respectively on said first and second bar ends and each having at least one threaded socket; and at least four insert weights for said dumbbell each insert weight having only one connector and that being a protruding threaded portion capable of removably attaching to one of said first and second end-weights through a mating threaded socket thereon;

whereby each insert weight is only capable of removably attaching to an end-weight and is incapable of receiving another insert-weight.

28. A variable weight dumbbell system comprising:

a dumbbell having a handle bar having first and second bar end defining an x-axis;

first and second end-weights at the respective said first and second bar end and each having at least two connectors of a male or female connector type; and a plurality of insert weights, each having only a single connector of the female or male connector type capable of mating with one of said end weight connectors to removably attach the same to one of said end-weights, whereby any one of the insert weights is only capable of removably attaching to one of the end-weights and is incapable of receiving another insert weight.

29. The dumbbell system of claim 1, 15 or 27 wherein there is only one of said threaded sockets on each end-weight.

30. The dumbbell system of claim 1, 15 or 27 wherein there is at least two of said threaded sockets on each end-weight.

31. The dumbbell system of claim 1 or 27 wherein said end-weights are permanently affixed to said handle bar.

32. The dumbbell system of claim 1, 15 or 28 consisting essentially of only of said end-weights, said insert weights with only one connector and said handle bar for each dumbbell.

33. The dumbbell system of claim 5 wherein said at least one socket opens outwardly in the direction of said x-axis and said plunger extends inwardly into said socket in a direction transverse to said x-axis, said at least one groove extends in a direction parallel to said x-axis, and said locking indentation opening outwardly in a direction transverse to said x-axis to receive said plunger.

* * * * *

UNITED STATES PATENT AND TRADEMARK OFFICE

CERTIFICATE OF CORRECTION

PATENT NO. : 5,464,379
DATED : November 7, 1995
INVENTOR(S) : Victor K. Zarecky

It is certified that error appears in the above-indentified patent and that said Letters Patent is hereby corrected as shown below:

Column 3, line 31, please delete "1.5, 1.5, 1.5, 1.5" and insert -- 1.25, 1.25, 1.25, 1.25 --.

Column 4, line 34, please delete "end-weight 11" and insert -- end-weights 13,14 --.

Column 5, line 22, please delete "82" and insert -- 83 --;
line 23, please delete "80" and insert -- 79 --.

Column 9, line 17, please delete "1.5, 1.5, 1.5, 1.5" and insert -- 1.25, 1.25, 1.25, 1.25 --;
line 64, please delete "1.5, 1.5, 1.5, 1.5" and insert -- 1.25, 1.25, 1.25, 1.25 --.

Signed and Sealed this
Ninth Day of April, 1996

Bruce Lehman

*Attest:*

BRUCE LEHMAN

*Attesting Officer*

*Commissioner of Patents and Trademarks*